US010337699B2

(12) United States Patent
Hierzer

(10) Patent No.: US 10,337,699 B2
(45) Date of Patent: Jul. 2, 2019

(54) LIGHT

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 0 days.

(21) Appl. No.: 15/702,254

(22) Filed: Sep. 12, 2017

(65) Prior Publication Data

US 2018/0073704 A1 Mar. 15, 2018

(30) Foreign Application Priority Data

Sep. 12, 2016 (DE) ..... 10 2016 217 332

(51) Int. Cl.

| | |
|---|---|
| ***F21S 4/00*** | (2016.01) |
| ***F21V 14/02*** | (2006.01) |
| ***F21S 8/02*** | (2006.01) |
| ***F21V 7/09*** | (2006.01) |
| ***F21S 2/00*** | (2016.01) |
| ***F21S 8/00*** | (2006.01) |
| ***F21S 8/04*** | (2006.01) |
| ***F21V 5/04*** | (2006.01) |
| ***F21V 7/00*** | (2006.01) |
| ***F21V 17/00*** | (2006.01) |
| *F21Y 105/16* | (2016.01) |
| *F21Y 115/10* | (2016.01) |

(Continued)

(52) U.S. Cl.

CPC ..... *F21V 14/02* (2013.01); *F21S 2/005* (2013.01); *F21S 8/02* (2013.01); *F21S 8/026* (2013.01); *F21S 8/033* (2013.01); *F21S 8/04* (2013.01); *F21V 5/048* (2013.01); *F21V 7/0066* (2013.01); *F21V 7/09* (2013.01); *F21V 17/002* (2013.01); *F21Y 2105/16* (2016.08); *F21Y 2115/10* (2016.08); *H05B 33/0842* (2013.01); *H05B 37/0272* (2013.01)

(58) Field of Classification Search

CPC .. F21V 14/02; F21V 7/09; F21S 8/026; F21Y 2015/16; F21Y 2115/10; H05B 33/0842; H05B 37/0272

USPC ..... 362/240

See application file for complete search history.

(56) References Cited

U.S. PATENT DOCUMENTS

| | | | |
|---|---|---|---|
| 8,230,690 | B1 | 7/2012 | Salessi |
| 8,657,466 | B2 | 2/2014 | Bosch et al. |

(Continued)

FOREIGN PATENT DOCUMENTS

| | | | |
|---|---|---|---|
| CN | 204513070 | U | 7/2015 |
| DE | 20308466 | U1 | 11/2003 |

(Continued)

OTHER PUBLICATIONS

English Abstract of DE202012010416, Publication Date: Feb. 27, 2013.

(Continued)

*Primary Examiner* — Karl D Frech

(74) *Attorney, Agent, or Firm* — Millen, White, Zelano & Branigan, P.C.; William Nixon

(57) ABSTRACT

A light has a light base body and lighting segments, which can be inserted into the light base body. Each of the lighting segments here emits light in a directional manner and has a predefined emission characteristic. Moreover, the emission characteristics of the lighting segments comprise at least two different emission characteristics.

28 Claims, 8 Drawing Sheets

(51) Int. Cl.
*H05B 33/08* (2006.01)
*H05B 37/02* (2006.01)

(56) References Cited

U.S. PATENT DOCUMENTS

| | | | | |
|---|---|---|---|---|
| 9,933,139 | B2 | 4/2018 | Skergeth | |
| 9,951,913 | B2 | 4/2018 | Skergeth et al. | |
| 2006/0152945 | A1 | 7/2006 | Lantzsch et al. | |
| 2010/0046227 | A1 | 2/2010 | Knoble | |
| 2013/0301264 | A1 | 11/2013 | Van Gompel | |
| 2015/0223402 | A1* | 8/2015 | Krijn | A01G 7/045 47/58.1 LS |
| 2016/0033099 | A1 | 2/2016 | Bergman | |

FOREIGN PATENT DOCUMENTS

| | | | |
|---|---|---|---|
| DE | 102006018298 | A1 | 10/2007 |
| DE | 102006045745 | A1 | 4/2008 |
| DE | 102009021208 | A1 | 11/2010 |
| DE | 202012010416 | U1 | 2/2013 |
| DE | 202014100948 | U1 | 7/2015 |
| DE | 202014100951 | U1 | 9/2015 |
| WO | 2014162298 | A1 | 10/2014 |

OTHER PUBLICATIONS

Office Action for DE-10 2016 217 332.4 dated May 5, 2017.
Search Report in corresponding EP application 17190665.4 dated Nov. 14, 2017 (pp. 1-6).
Search Report in corresponding EP application 17190665.4 dated Apr. 17, 2019 (pp. 1-5).
Search Report in corresponding AT application 50993/2016-1 dated Apr. 16, 2019 (pp. 1-4).

* cited by examiner (I-I)

(II-II)

LIGHT

FIELD OF THE INVENTION

The invention concerns a light, which can be used for example for the illumination of premises, of interior rooms or parts of buildings or of architectural features or objects or persons located in premises.

TECHNICAL BACKGROUND

Although the invention can be useful in many areas where the illumination of objects or features is desirable or necessary, the invention and its underlying problems shall be explained more closely below with the example of the lighting of an interior room in a building.

It is generally known how to arrange lights for the illumination of an interior room, for example in a ceiling region. If for example a corridor is lit with the aid of individual ceiling spotlights, however, a relative large number of these spotlights will be required to illuminate it in the desired manner, given the elongated shape of the corridor. Furthermore, the light given off by the individual traditional spotlights also in this way often falls on portions of the interior room which are not meant to be lit, while other areas in turn are not as well lit as desired.

Furthermore, it can happen that such a traditional lighting solution does not fully meet the aesthetic demands placed on the lighting in all situations in which illumination is desired.

Moreover, it is basically known that reflectors of light sources such as floodlights can be outfitted with free-form surfaces.

SUMMARY OF THE INVENTION

Against this background, it is an idea of the present invention to provide a light which avoids the above-mentioned drawbacks of traditional lighting fixtures and offers improved lighting possibilities in order to illuminate the regions or objects needing to be lit in a more targeted and efficient manner and which meets in flexible manner the aesthetic demands on the achieved light effect in many kinds of situations.

Accordingly, a light is proposed which comprises a light base body and lighting segments which can be inserted into the light base body. It is provided here that each of the lighting segments gives off light in directional manner and has a predefined emission characteristic. The emission characteristics of the lighting segments here comprise at least two different emission characteristics.

One insight on which the present invention is based is that the light given off by the lighting segments in this way can be used more efficiently than when using traditional spotlights. In particular, it is possible to light up desired areas specifically, to avoid a direct illumination of areas which are not meant to be lit, and to accomplish different aesthetic lighting effects in flexible manner, in order to set the stage for a room and/or an object and/or a person in different ways, for example. Moreover, lights can be spared thanks to the more efficient, more effective output of light, and moreover the more efficient use of the light given off can also afford the advantageous possibility of an energy saving. Thus, in particular, a light can be created on the modular principle. In other words, in particular, a flexible-use lighting system is provided on the modular principle, comprising the light base body and the lighting segments.

By an emission characteristic in the present case is meant the directional luminous power (quantum) emitted by a lighting segment. In particular, the term emission characteristic shall furthermore be understood to mean that a mere rotation or swiveling or other repositioning of a lighting segment does not change its emission characteristic.

In one embodiment, at least two lighting segments can be inserted into the light base body. The light base body in this case is designed for an inserting of at least two lighting segments in it. In particular in this case, when using the light the consumer can insert the total number of the at least two or more lighting segments which can be inserted into the light base body in the latter for certain applications, while for other applications the consumer can install fewer lighting segments in the light base body than the design of the light base body makes possible. A very flexible use of the light is made possible by this modular design. For example, a retrofitting of the light can also easily be done in event of remodelling, for example in business premises.

In one embodiment, the lighting segments can be inserted into the light base body at predefined, for example at regularly arranged, positions. This makes possible a high flexibility when fitting the light base body, for example with a selection from a total number of available lighting segments. In particular, lighting segments which are substantially identical in their outer configuration can thus be combined in flexible manner.

The lighting segments in one modification can be inserted for example at positions which are dictated by a regular grid network, for example, with mutually perpendicular intersecting grid lines.

In one embodiment, the lighting segments can be inserted into the light base body such that the inserted lighting segments form an array extending in a plane, especially a horizontal or vertical plane in a mounted state of the light. In this way, a diversity of light effects can be achieved by means of the emission characteristics of the lighting segments without complicated rotation and swiveling mechanisms for the individual lighting segments. For example, if the plane runs substantially horizontally in the mounted state of the light, floor areas, wall areas, or both can be illuminated by choice, wherein the lighting segments do not need to be adjusted by swiveling or rotation, but instead can be arranged in a fixed orientation and beam light from the horizontal. In similar manner, light effects can be created by choice in floor, wall, and/or ceiling areas if the plane runs substantially vertically, wherein the lighting segments in a preferably fixed orientation will then beam light from the vertical. In particular, by an arrangement of the lighting segments in accordance with this embodiment the light can be used to achieve light effects for example in both horizontal and vertical partial areas of a room. The creating of such light effects with an array of lighting segments extending substantially in a plane can achieve an interesting aesthetic effect and furthermore be of advantage, for example, when using the light in a grid ceiling.

For example, the array can be formed such that the lighting segments are inserted into the light base body alongside one another for example in the horizontal or vertical plane in one row or in two directions in matrix fashion.

In one embodiment, in the mounted state of the light the plane in which the array extends can run substantially parallel to a ceiling or substantially parallel to a wall of a room.

In another embodiment, two or more of the inserted lighting segments can have the same emission characteristic.

For example, this can make it possible to provide several identical light effects or a greater light effect of one kind.

In one embodiment, the lighting segments each have an optical component which is used in each case to accomplish the emission characteristic of the lighting segment. Here, in one modification, the light can be outfitted in particular with lighting segments so that the light has such optical components of at least two differently designed types. Thus, it is possible to provide different emission characteristics in an expedient manner.

In one embodiment, at least one of the lighting segments comprises a reflector as the optical component, or several or all of the lighting segments each comprise a reflector as the optical component, wherein the reflector can have at least one light-reflecting partial surface configured as a free-form surface. In one modification of this embodiment, at least one of a plurality of light-reflecting partial surfaces of the reflector is designed as a standard reflector surface or as part of a standard reflector surface and at least one is designed as a free-form surface. In this way, the emission characteristic of the lighting segment can be effectively influenced and the reflector here can advantageously be designed with relatively small dimensions.

A standard reflector surface can be, for example, a reflector surface of parabolic shape, especially a reflector surface of parabolic shape with facetted structure. The standard reflector surface might thus be, for example, a paraboloid surface or part of such a surface, optionally with facetted structure.

A free-form surface, on the other hand, can be geometrically freely configured in order to specifically influence the reflection process on the light-reflecting partial surface configured as the free-form surface and to alter or optimize the resulting light distribution and thus the emission characteristic.

Thus, in this case the light in one embodiment can be outfitted with lighting segments in particular so that the light has reflectors of at least two differently designed types. This advantageously enables different emission characteristics and different light effects. In another embodiment, however, several of the reflectors can be of the same type.

In one embodiment, at least two of the light-reflecting partial surfaces are designed in each case as a standard reflector surface or as part of a standard reflector surface and at least two of the light-reflecting partial surfaces are designed in each case as a free-form surface.

According to one modification, the reflector comprises two light-reflecting partial surfaces, each one configured as a standard reflector surface or as part of a standard reflector surface, which are arranged opposite each other. Moreover, the reflector here comprises two light-reflecting partial surfaces configured as free-form surfaces, which are arranged opposite each other. This can be useful, for example, in order to create a rather elongated cone of light to light up extensive areas, such as corridors.

In one embodiment, the reflector is designed with four light-reflecting sides. Such a reflector can form a component of a four-sided lighting segment in harmonious manner.

In one embodiment, in each case adjacent light-reflecting partial surfaces are joined together at one of a plurality of corners of the reflector. A shape of the reflector with a plurality of corners can in turn contribute to adjusting the desired emission characteristic.

In one embodiment, at least one of the free-form surfaces is designed as a bulging convexity towards an inner region of the reflector. This can also be advantageous for creating a light distribution which should be adapted to a rather elongated area needing to be lit up, for example.

In one embodiment, the reflector is formed as an injection moulded part. Furthermore, the reflector can have in this case, for example, a reflective layer connected to the injection moulded component. Such a reflector can be produced at relatively low cost, even when the reflector has a complex configuration.

In other embodiments of the invention, the reflector can be produced by means of a different manufacturing process. For example, the reflector can be made by shaping a metal sheet, for example by means of one or more of the following methods: roll forming or cold rolling, bending, stretch forming, drawing methods such as deep drawing, pressing, embossing, stamping, deforming—for example deep drawing—by means of a rubber pad, pressing, superplastic forming, hammering or driving, explosion forming, magnetic pulse forming.

In particular, according to one modification it is provided that the shape of the reflector cannot be altered by a user, but instead is fixed. However, in embodiments of the invention a number of lighting segments can be provided, each with different reflector shape for different applications and/or effects, wherein the reflector shape can thus be varied by a corresponding choice of the lighting segments already during the first-time assembly of the configuration of the light or by later exchanging of the lighting segments as required. Thus, complicated and time-consuming adjustment processes are eliminated. Instead, the light can advantageously be configured suitably by a customer, for example already when ordering of the light for the desired purpose of use, for example by suitable assembly of lighting segments with different emission characteristics.

In particular, in embodiments of the invention, several lighting segments can be combined in a light, each having different reflectors, with at least one light-reflecting partial surface configured as a free-form surface.

In one embodiment, advantageously a plurality of reflectors with the same outer contour is provided, but which confer on the lighting segments a different emission characteristic each time. Thus, lighting segments with the most diverse of emission characteristics can be offered, which can be selected by a customer as needed and inserted into the light base body. Thanks to the same outer contour of the reflector, such lighting segments work well together, both as regards the space requirement in the light base body and as regards the aesthetic effect. In other embodiments, for example, the reflectors of all lighting segments can have substantially the same outer contour. From aesthetic standpoints, and also when inserting the lighting segments, this can be especially practical and convenient. Alternatively, the lighting segments of the light can form groups within which the outer contour of the reflectors is the same each time.

The outer contour of the reflector can be, for example, rectangular, especially square, or round, especially circular round, in embodiments. Combinations of reflectors with rectangular and round outer contours are also conceivable.

In one embodiment, at least one of the lighting segments comprises a lens as the optical component, or several or all of the lighting segments each comprise a lens as the optical component. An effective influencing of the emission characteristic of the lighting segment can likewise be accomplished by means of a lens.

In particular, the light in another embodiment can be outfitted in this case with lighting segments such that the light has lenses of at least two differently designed types. This, in turn, advantageously enables different emission characteristics and different light effects. In another embodiment, however, several of the lenses can be of the same type.

According to one modification, it can be provided in particular that the shape of the lens cannot be altered by a user, but instead is fixed. In embodiments of the invention, a number of lighting segments can be provided, each with lenses of different action, such as different lens shape, for different applications and/or effects. Thus, the lens type here can be varied by a corresponding choice of the lighting segments already during the first-time assembly of the configuration of the light or by later exchanging of the lighting segments as needed. Thus, complicated and time-consuming adjustment processes are eliminated, and instead the light can advantageously be configured suitably by a customer, for example already when ordering the light for the desired purpose of use, for example by suitable assembly of lighting segments with different emission characteristics.

In particular, in embodiments of the invention, several lighting segments can be combined in a light, having differently configured lenses.

In one embodiment, advantageously a plurality of lenses with the same outer contour is provided, which confer on the lighting segments a different emission characteristic each time. Thus, lighting segments with the most diverse of emission characteristics can be offered also when the optical component is configured as a lens, which can be selected by a customer as needed and inserted into the light base body. Thanks to the same outer contour of the lens, such lighting segments work well together, both as regards the space requirement in the light base body and as regards the aesthetic effect. In other embodiments, for example, the lenses of all lighting segments can have substantially the same outer contour. From aesthetic standpoints, and also when inserting the lighting segments, this can be especially practical and convenient. Alternatively, the lighting segments of the light can form groups within which the outer contour of the lenses is the same each time.

The outer contour of the lens can be, for example, rectangular, especially square, or round, especially circular round, in embodiments. Combinations of lenses with rectangular and round outer contours are also conceivable.

The lens in one modification can be a lens whose action is in large part based on total internal reflection (TIR lens).

In another embodiment of the invention, at least one of the lighting segments can have a lens as the optical component, while at least one other of the lighting segments has a reflector as the optical component. In particular, the reflector in this case has at least one light-reflecting partial surface configured as a free-form surface. Thus, according to this embodiment, at least one lighting segment with lens is combined with at least one lighting segment with reflector. This can act even more advantageously on the diversity of light effects which can be created.

In one embodiment, the lighting segments are designed as interchangeable lighting segments. Thus, one or more lighting segments can advantageously be exchanged in order to replace the lighting segment or segments with one or more lighting segments having a different emission characteristic and to vary the achievable light effects. Furthermore, a possibly damaged lighting segment can be easily replaced in this way.

For example, the lighting segments can be designed as interchangeable spotlights. The interchangeability enables not only the replacement of a lighting segment when damaged, but also a certain variability of the light in the event of changes for example in the surroundings to be illuminated by means of the spotlights. Thus, for example, light effects can be varied in simple manner, i.e., the illumination function of the light can be influenced diversely by changing the lighting segments.

For example, the light base body in one embodiment can be rectangular, especially square. A rectangular or square light base body can be serviceable, for example, when the light is supposed to be installed in a grid of a false ceiling.

In one embodiment, four to nine lighting segments or four to sixteen lighting segments can be insertable in the light base body, for example. In particular, for example, a rectangular grid pattern in this case can be provided with 2×2 installation positions for lighting segments or with 3×3 such installation positions or with 4×4 such installation positions. In modifications, however, such grid patterns with n×n or n×m positions are generally conceivable, where n and m each stand for a whole number.

In one embodiment, the light can be fine tuned as a whole, for example, by fine-tuning the angular position of the entire light in a limited angle range. This can be useful, for example, in order to perform yet another fine-tuning or fine correction of the achieved illuminating effect after the installation of the light and to balance out any installation tolerances in this way.

In another embodiment, the lighting segments are inserted into the light base body at fixed positions and furthermore they cannot be moved or adjusted with respect to the light base body after being inserted, which simplifies the construction of the light, and the light can be manufactured more cheaply. However, in one modification it is conceivable here for the lighting segments to each be designed so that they can be inserted into the light base body in one of several defined angle positions, for example, rotated in steps of 90 degrees.

In one embodiment, the output of light of the lighting segments can be switched and/or be controlled specifically for individual lighting segments and/or for subgroups of the lighting segments so that different light effects can be achieved by means of the light. In particular, the most diverse of possibilities are conceivable here for turning lighting segments on or off individually or in combination with each other or controlling their output of light in order to make possible the most diverse of lighting effects.

According to one modification, the output of light of the lighting segments can be switched and/or be controlled such that several lighting segments, especially several identically configured lighting segments, of a first subgroup of lighting segments can be activated at the same time to put out light, in order to create a first light effect by the interaction of the lighting segments of the first subgroup, and that moreover several lighting segments, especially several identically configured lighting segments, of another subgroup of lighting segments can be activated at the same time to put out light, in order to create another light effect by the interaction of the lighting segments of the other subgroup. The other light effect in this case is different from the first light effect. In this way, different light effects can be effectively achieved by means of appropriately adapted lighting segments. In one modification, several or all of the lighting segments assembled into a subgroup can be different in configuration if this is useful to the creation of the desired light effect.

In one modification, the first and second subgroup of lighting segments are disjunctive. According to an alternative modification, however, the first and second subgroup can instead comprise one or more common lighting segments.

In other embodiments, more than two subgroups of lighting segments can be provided in order to create further light effects, such as three or four subgroups or even more.

In one embodiment, the light effects comprise a specific, especially a direct illumination of a wall or a predefined area of a wall, and/or a specific, especially a direct illumination of a floor or a predefined area of a floor, and/or a specific, especially a direct illumination of an object placed in a room or a person located in a room.

It can thus be provided in one embodiment of the invention that the wall or the predefined area of the wall can be illuminated by means of a subgroup of several identically configured lighting segments, while the floor or the predefined area of the floor can be illuminated by means of another subgroup of other lighting segments, yet once again identically configured among each other, while the two subgroups can be used in combination by appropriate switching and/or actuating of the lighting segments for the simultaneous illumination in the wall and floor area.

In other embodiments, however, it can be provided that the illumination of the wall or the predefined area of the wall and/or the illumination of the floor or the predefined area of the floor and/or the illumination of the object placed in the room or the person located in the room can be done in each case by means of a single lighting segment coordinated with the particular lighting effect.

In another embodiment, the light effects comprise a specific, especially a direct illumination of a wall or a predefined area of a wall, and/or a specific, especially a direct illumination of a floor or a predefined area of a floor, and/or a specific, especially a direct illumination of ceiling or a predefined area of a ceiling, and/or a specific, especially a direct illumination of an object placed in a room or a person located in a room.

Thus, in another embodiment of the invention it can be provided that the wall or the predefined area of the wall can be illuminated by means of a subgroup of several identically configured lighting segments, while the floor or the predefined area of the floor can be illuminated by means of another subgroup of other lighting segments, yet once again identically configured among each other, while the ceiling or the predefined area of the ceiling can be illuminated by means of yet another subgroup of still other lighting segments, yet once again identically configured among each other, for example. The subgroups can be used in combination by appropriate switching and/or actuating of the lighting segments for the simultaneous illumination in the wall, floor, and ceiling area.

In other embodiments, however, it can be provided that the illumination of the wall or the predefined area of the wall and/or the illumination of the floor or the predefined area of the floor and/or the illumination of the ceiling or the predefined area of the ceiling and/or the illumination of the object placed in the room or the person located in the room can be done in each case by means of a single lighting segment coordinated with the particular lighting effect.

In one modification, the ability to create one or more of the light effects by means in each case of a single one of the lighting segments can be combined with the ability to create another one or several of the other light effects by means of a subgroup of lighting segments.

In one embodiment, the lighting segments each comprise a device which makes it possible to receive control signals for the switching and/or controlling of the output of light of the lighting segment in wireless or wired manner. In one modification, devices can be provided here which enable the reception of the control signals in both wireless and wired manner. The lighting segments in this case are designed to switch and/or control the output of light in accordance with the control signals. In this way, it becomes possible for the lighting segments to respond in flexible manner and at the same time to limit the wiring expense.

In one embodiment, the lighting segments each comprise a communication device, which enables a reception of the control signals in wireless manner and in particular comprises an interface for communication by a wireless protocol. Alternatively or additionally, the lighting segments can each comprise an interface for connection to a wired bus or a wired network which enables the reception of the control signals.

In one embodiment, an outer contour of at least one of the lighting segments, several of the lighting segments or all of the lighting segments is polygonal, especially rectangular or square. Alternatively, an outer contour of at least one of the lighting segments, several of the lighting segments or all of the lighting segments can be round, especially circular round. In another alternative embodiment, an outer contour of at least one of the lighting segments is round, especially circular round, and an outer contour of at least one other of the lighting segments is polygonal, especially rectangular or square. For example, an interesting aesthetic effect can be achieved when the lighting segments all have a relatively simple, for example the same outer contour, yet are different in terms of their emission characteristic. A rectangular outer contour can furthermore be advantageous for inserting a plurality of lighting segments into a substantially rectangular light base body.

In modifications of the invention, the light can be designed for an arrangement of the light in the ceiling area and/or for an arrangement of the light in the wall area.

In one embodiment, the light is designed as a grid light for arrangement in a grid ceiling. Thus, it is advantageously possible, even in cases in which the arrangement and fastening of the light are oriented for example to the grid of a grid ceiling, to provide light effects in a flexible and diversified manner.

In an alternative embodiment, the light is designed as an installed light. In this case, for example, the light can be provided and designed for an installation in a ceiling and/or for an installation in a wall.

According to another alternative embodiment, the light is designed for use as a suspended light, wherein the light for example can have an independent housing for use as a suspended light.

In another alternative embodiment, the light is designed for mounting on a wall. For this, in particular, the light can have an independent housing which makes it possible to arrange the light in the wall region on the surface of the wall. Alternatively, the light could be designed for mounting on a surface of a ceiling and in particular have an independent housing which is designed for an arrangement of the light on the surface of the ceiling.

In this way, the most diverse of illumination requirements can be met.

In one embodiment, the lighting segments are each outfitted with an LED or an LED array to produce light. In this way, an energy-efficient and long-lived light can be provided.

The above embodiments and modifications can be combined with each other as desired, so long as this makes sense. Further possible embodiments, modifications, and implementations of the invention also comprise combinations, which are not explicitly mentioned, of features of the invention described above or in the following with respect to exemplary embodiments. In particular here, the skilled person will also add individual aspects as improvements or supplementations of the particular basic form of the present invention.

BRIEF DESCRIPTION OF THE DRAWINGS

The invention shall be explained more closely below with the aid of the exemplary embodiments indicated in the schematic figures of the drawings. There are shown.

The enclosed drawings should provide a further understanding of the embodiments of the invention. They illustrate embodiments and serve in conjunction with the description to explain principles and concepts of the invention. Other embodiments and many of the mentioned benefits will emerge by viewing the drawings. The elements of the drawings are not necessarily shown true to scale with respect to each other.

In the figures of the drawings, the same, functionally identical or equally operating elements, features and components—unless otherwise specified—are each provided with the same reference number.

DESCRIPTION OF EXEMPLARY EMBODIMENTS

Figure 1:
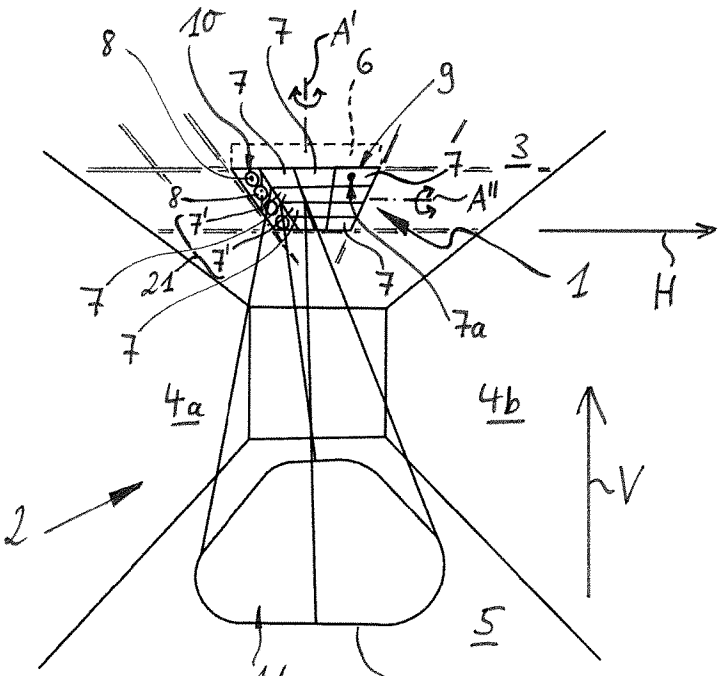
FIG. 1 a light according to a first exemplary embodiment of the invention, mounted in a room in the ceiling region, when creating a first, schematically represented light effect.

FIG. 1 shows a light 1 according to a first exemplary embodiment. Moreover, FIG. 1 shows a room 2 in a building, not otherwise shown in its entirety, wherein the room 2 in the exemplary embodiment shown has a relatively narrow and elongated shape. For example, the room 2 can be a corridor inside the building. However the room 2 can also be some other premises, such as an office space or the like. The room 2 has a grid ceiling 3, forming a suspended false ceiling. Moreover, the room 2 has a first wall 4*a*, a second wall 4*b* and a floor 5. The light 1 is designed as a grid light for mounting in the grid ceiling 3 and is fastened in the grid ceiling 3, which is merely suggested but not represented in detail in FIG. 1.

Figure 1A:
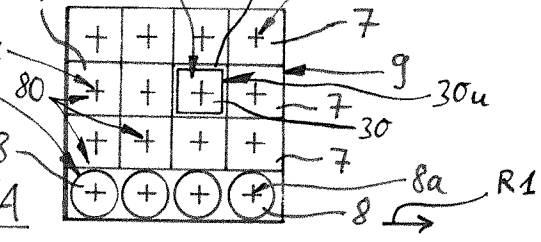
FIG. 1A a schematic illustration to show the positioning of lighting segments in the light of FIG. 1, as seen in a top view of a visible side of the light.

The light 1 comprises a square light base body 6 and several lighting segments 7 and 8 which can be inserted into the light base body 6, the lighting segments 7 and 8 in FIG. 1 being inserted at predefined positions 7*a* and 8*a* into the light base body 6, also see FIG. 1A. For better clarity, not all the lighting segments and positions in FIGS. 1 and 1A are provided with reference numbers. For example, the light 1 of FIG. 1, 1A comprises four lighting segments 8 and twelve lighting segments 7. An outer contour 9 of each of the lighting segments 7 has a square configuration in FIG. 1. On the other hand, an outer contour 10 of each of the lighting segments 8 has a circular round configuration. The outer contours 9 of the lighting segments 7 as well as the outer contours 10 of the lighting segments 8 are each identical in configuration.

FIGS. 1 and 1A moreover show that the positions 7*a* of the lighting segments 7 and the positions 8*a* of the lighting segments 8 are in each case in a regular arrangement. While the lighting segments 8 are arranged along a straight line, the lighting segments 7 are arranged at positions 7*a* corresponding to the points of intersection of an orthogonal grid pattern. In the first exemplary embodiment, however, the positions 8*a* also form further points of intersection of the grid pattern, which already defines the positions 7*a*, see FIG. 1A.

Figure 2:
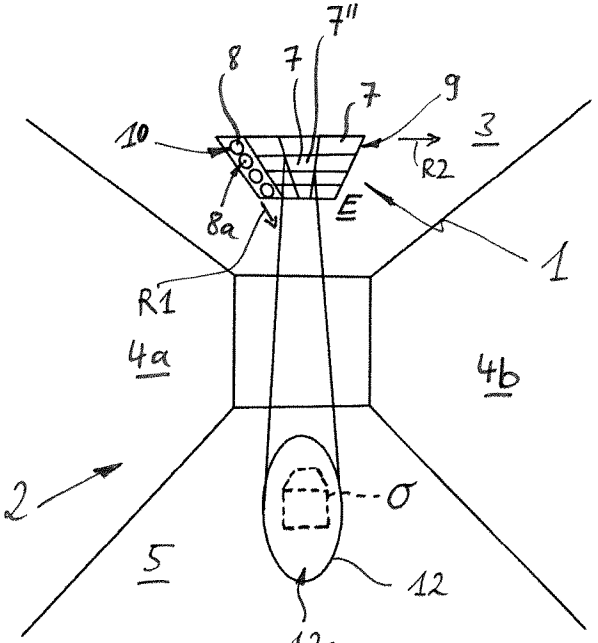
FIG. 2 the light of FIG. 1 when creating a second, schematically represented light effect.

The lighting segments 7 and 8 thus form in their inserted state, see FIGS. 1A and 2, an array 80 which extends in a plane E. The plane E in FIGS. 1, 1A and 2 in the mounted state of the light 1 shown there runs horizontally and parallel to a plane in which the grid ceiling 3 extends, while the plane E and the plane of the grid ceiling 3 can coincide. A horizontal direction H with respect to the room 2 is drawn in FIG. 1 for clarity. The plane E, see FIGS. 1A and 2, is thus subtended by two directions R1, R2, which run in FIG. 1A perpendicular to each other and parallel to the grid ceiling 3, or in the plane of the grid ceiling 3.

The lighting segments 7 and 8 are each designed to be inserted into the light base body 6 and thus in particular to be removably inserted therein. For example, the lighting segments 7, 8 and/or the light base body 6 can be provided with suitable locking devices by means of which the lighting segments 7 and 8 can each be locked upon being inserted into the light base body 6 and are thus held therein, especially in removable manner. It can be provided in this case that the locking insertion of the lighting segments 7, 8 is possible each time in several rotary positions, for example, in several positions rotated about an axis parallel to the vertical axis V, and especially normal to the plane E, through the centre point of the lighting segment. A locking insertion could be possible in a plurality of steps, offset by a predefined angle, such as steps of 90 degrees.

The lighting segments 7 and 8 in the first exemplary embodiment are designed as interchangeable spotlamps, especially spotlights. Thus, each of the lighting segments 7, 8 emits light in a directional manner and has a predefined emission characteristic. The emission characteristics of the lighting segments 7, 8 of the light 1, however, are not all identical, but rather the total set of the emission characteristics of the lighting segments 7, 8 comprises several different emission characteristics.

Each of the lighting segments 7, 8 comprises one or more light sources, enabling a directional output of light by the lighting segments 7, 8. The output of light of the lighting segments 7, 8 in the light 1 of FIG. 1 can be specifically switched and/or controlled at least in the manner schematically illustrated in FIGS. 1 to 4 in order to create several different light effects. The switching and/or controlling of the output of light of a lighting segment 7, 8 can comprise, in particular, an entire switching off of the lighting segment, a switching on of the latter at full power, or as needed a switching on of the lighting segment at a predefined power level below full power. Moreover, the switching and/or controlling of the output of light can additionally involve a continuous regulating of the output of light in the sense of a dimmer.

FIG. 1 shows schematically the providing of a first light effect 11 by means of the light 1 according to the first exemplary embodiment. For this, two lighting segments 7 have been activated, being additionally denoted by the reference number 7' for better clarity, while the other lighting segments 7, 8 are switched off. The two lighting segments 7' each have an emission characteristic which makes it possible, by means of the two lighting segments 7', to produce together a light distribution which enables a direct lighting of a predefined area 11*a* of the floor 5 of the corridor 2. For this, it is useful for the lighting segments 7' to produce an elongated light distribution, which is better adapted to the elongated shape of the room 2 than a circular round cone of light. Thus, with the one light 1, an efficient lighting is possible.

In FIG. 2, instead of the lighting segments 7', a single lighting segment 7 has been activated, denoted in FIG. 2 by the reference number 7", while the other lighting segments 7, 8 are switched off. The emission characteristic of the lighting segment 7" differs from that of the lighting segments 7'. The lighting segment 7" produces on the floor 5 a round, for example a circular round or elliptical distribution of light in a region 12*a* as a second light effect 12. In contrast with a larger area of illumination of the floor 5, for example, as in FIG. 1, a different mood is created in FIG. 2 by the light effect 12 and the room 2 is staged differently than in FIG. 1. In FIG. 2, a smaller and differently shaped predefined region 12*a* of the floor 5 than in FIG. 1 is illuminated directly. Optionally, an object O, shown by hatching in FIG. 2, can be present in the room 2, for example standing on the floor 5, and it is specially illuminated and staged by means of the light effect 12. In place of the object O, a person located in the room 2 could be illuminated by means of the activated lighting segment 7".

Figure 3:
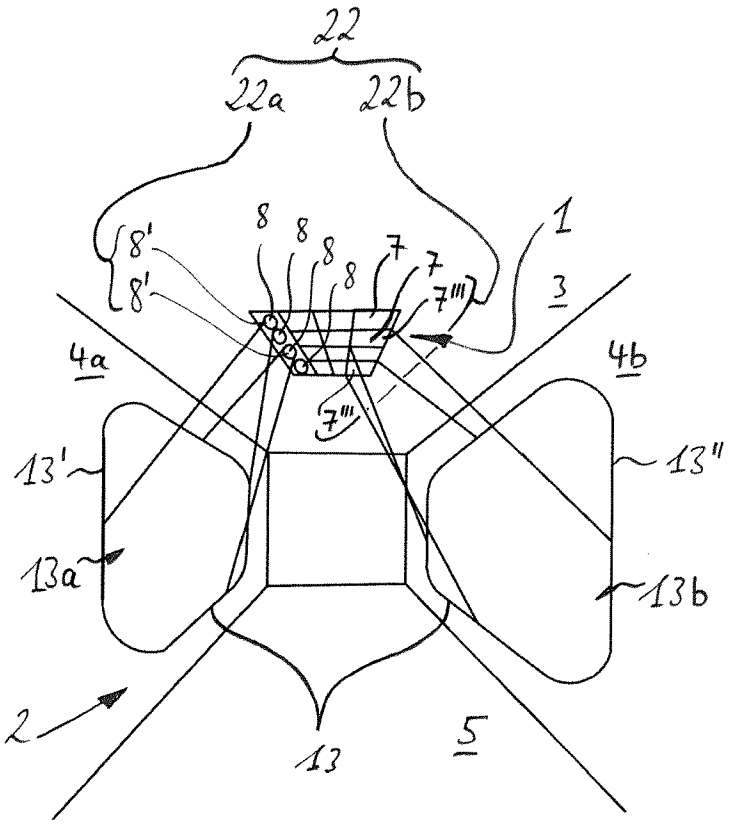
FIG. 3 the light of FIG. 1 when creating a third, schematically represented light effect.

In FIG. 3, two of the lighting segments 8 denoted by the reference number 8' as well as two of the lighting segments 7 denoted by the reference number 7'" are activated in order to produce a third light effect 13. The third light effect 13 contains two individual light effects 13' and 13" and involves a direct illumination of both walls 4*a*, 4*b* of the room 2 in rather elongated illuminated regions 13*a*, 13*b*, yet without the floor 5 being specifically and directly illuminated. In this way, once again a different mood is created in the room 2. Objects located on the walls, if present, can be shined upon, or only the wall surface and structure is illuminated in order to set the scene in the room 2.

Figure 4:
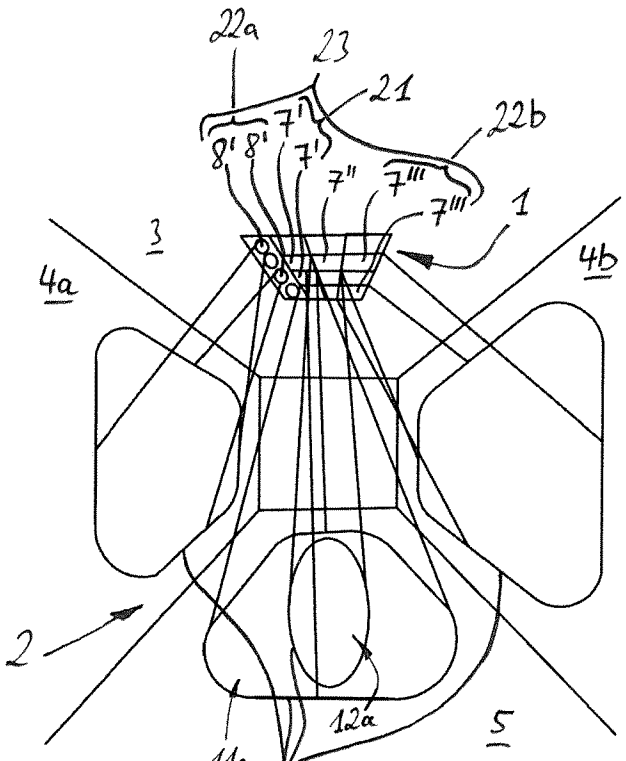
FIG. 4 the light of FIG. 1 when creating a fourth, schematically represented light effect.

In FIG. 4, the output of light of the lighting segments 7, 8 of the light 1 is switched and/or controlled such that the illumination effects shown schematically in FIGS. 1, 2 and 3 are combined and thus form a fourth light effect 14. The fourth light effect 14 thus combines the direct illumination of the walls 4*a*, 4*b* as in FIG. 3 with the lighting of the floor 5 according to FIG. 1 and with a thus intensified lighting of a circular round or elliptical region 12*a* of the floor 5, within the floor region 11*a* already illuminated by means of the lighting segments 7'.

In order to create the light effects 11-14 shown schematically in FIGS. 1, 2, 3 and 4, individual lighting segments 7, 8 of the light 1 or subgroups of the lighting segments 7, 8 are specifically turned on or off, or their output of light is specifically controlled.

In FIG. 1, the lighting segments 7', which can have the same configuration, form a first subgroup 21 of lighting segments 7, which are activated at the same time in order to create the first light effect 11 by interaction of the lighting segments 7' of the first subgroup 21. On the other hand, in FIG. 2, a single lighting segment 7" was activated to produce the second light effect 12.

In FIG. 3, the lighting segments of a second subgroup 22, comprising two lighting segments 8' as well as two lighting segments 7'", see FIG. 3, were activated at the same time in order to create the third light effect 13, while a third subgroup 22*a*, comprising the two lighting segments 8', for example of identical design, serves to illuminate the region 13*a* on the first wall 4*a* and a fourth subgroup 22*b*, comprising the two lighting segments 7'", for example of identical design, serves to illuminate the region 13*b* on the second wall 4*b*. Thus, the lighting segments 8' of the third subgroup 22*a* together create the light effect 13' on the first wall 4*a*, while the lighting segments 7'" of the fourth subgroup 22*b* together create the light effect 13" on the second wall 4*b*. The third light effect 13 is formed by the interplay of the light effects 13', 13".

In FIG. 4, the subgroups 21, 22*a*, 22*b* as well as the lighting segment 7" are activated at the same time in order to provide the light effect 14. The lighting segments 8', 7', 7", 7'" form the fourth subgroup 23, shown schematically in FIG. 4.

FIG. 1-4 make it clear that the light effects 11, 12, 13' and 13" are different from each other. The light effects 13 and 14 are also different from the individual light effects 11, 12, 13', 13", which by combining some or all of the light effects 11, 12, 13', 13" new and different illumination effects are created. The subgroups 21, 22*a*, 22*b* are disjunctive and thus contain no common lighting segments, whereas the subgroups 21, 22*a* and 22*b* are all three contained in the fifth subgroup 23.

It thus becomes evident that the light 1 advantageously enables the creating of light effects especially in vertical and horizontal partial areas or areas of the room 2, such as in the area of the floor 5 and the walls 4*a*, 4*b*, without needing a rotating or swiveling of spotlights in order to vary the light effects. The lighting segments 7, 8 emit light from the horizontally extending array 80 into the room 2, for example onto one or more regions of the walls 4*a* and/or 4*b* or the entire wall 4*a* and/or 4*b*, and alternatively or in combination with this onto one or more regions of the floor 5 or the entire floor 5. Thus, with a fixed light 1 having in the mounted condition a horizontally designed, fixed array 80 of the lighting segments 7, 8, the most diverse lighting effects can be produced in the horizontal and also in particular in the vertical. The variation of the light effects occurs here in simple manner by switching and/or controlling of the output of light of individual lighting segments 7, 8 or groups thereof.

Each of the lighting segments 7 and 8 has, according to the first exemplary embodiment, an optical component 25 designed as a reflector 30, which is used to accomplish the emission characteristic of the lighting segment 7, 8 in each case. In order to achieve different emission characteristics, the light 1 is outfitted with lighting segments 7 and 8 such that the light 1 contains different such reflectors 30. The light 1 comprises lighting segments 7, 8 with at least two different reflector types to produce at least two different emission characteristics, so as to be able to provide different light effects.

Figure 5:
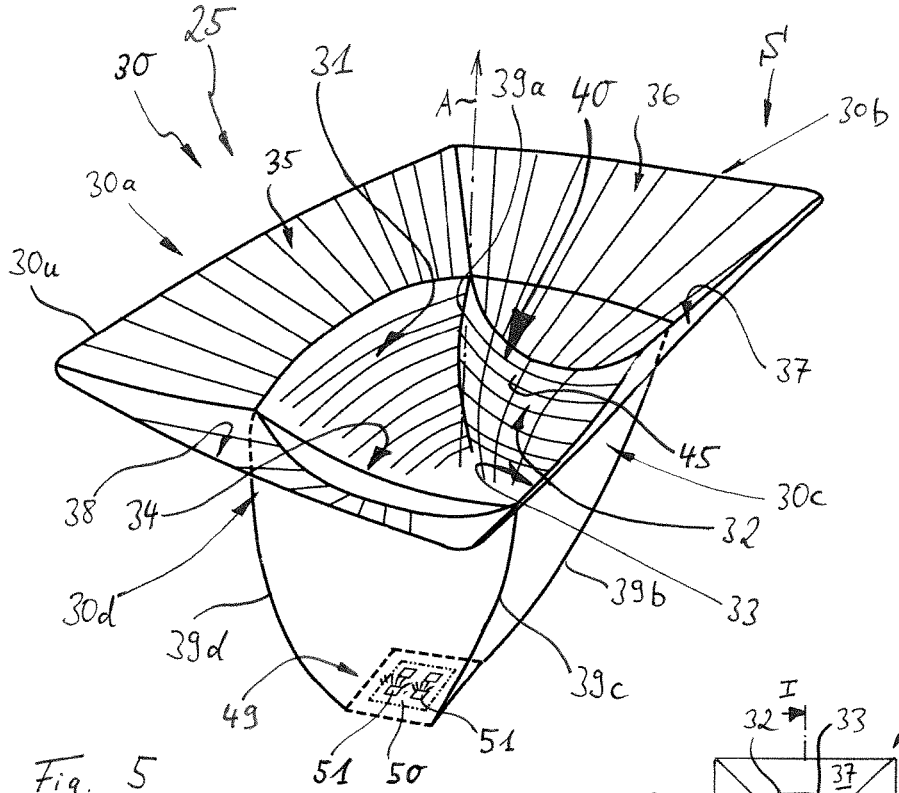
FIG. 5 a reflector of a lighting segment for the light according to the first exemplary embodiment, in schematic perspective view, together with an LED array.
Figure 5A:
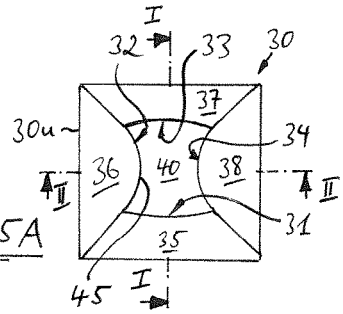
FIG. 5A the reflector of FIG. 5 in a schematic top view as seen from a visible side.

FIGS. 5 and 5A show schematically a reflector 30 for a lighting segment 7 of the light 1 according to the first exemplary embodiment. The lighting segment 7 can be, for example, one of the lighting segments 7' of the first subgroup 21.

The reflector 30 is made for example by means of injection moulding and has several light-reflecting partial surfaces 31, 32, 33, 34, 35, 36, 37, 38. Instead of this, however, the production of the reflector 30 could be done alternatively by means of a different manufacturing method, such as the forming of a metal sheet cut-out. The two light-reflecting partial surfaces 31 and 33 are arranged opposite one another and are each formed as part of a standard reflector surface. Moreover, the two light-reflecting partial surfaces 32 and 34 are arranged opposite one another and are each formed as a free-form surface. With the aid of the free-form surfaces 32 and 34, influence can be exerted specifically on the emission characteristic of the lighting segment which is outfitted with the reflector 30.

Moreover, FIG. 5 shows schematically a light source 49 which is formed in this exemplary embodiment as a LED array 50 with several light-emitting diodes (LEDs) 51. The LED array 50, like the reflector 30, forms a component of a lighting segment and is polygonal for example in FIG. 5, but it should be mentioned that the light source 49 can also be shaped otherwise, such as round. Moreover, instead of LEDs other light sources, such as halogen lamps, are conceivable.

Moreover, FIG. 5 indicates a visible side S of the reflector 30, which is turned towards the room 2 in the condition of the lighting segment inserted into the light base body 6. The reflector 30 is open towards the visible side S, in order to shine the light with the desired emission characteristic. FIG. 5A shows the reflector 30 schematically in a top view of the visible side S.

The reflector 30 comprises four light-reflecting sides 30*a*, 30*b*, 30*c*, 30*d*, wherein in each case adjacent light-reflecting partial surfaces 31-38 are joined together at one of a plurality of corners 39*a*-39*d* of the reflector 30. Specifically, the partial surfaces 31 and 32 as well as 35 and 36 are joined together each at the corner 39*a*, the partial surfaces 32 and 33 as well as 36 and 37 are joined together each at the corner 39*b*, the partial surfaces 33 and 34 as well as 37 and 38 are joined together each at the corner 39*c*, and the partial surfaces 34 and 31 as well as 38 and 35 are joined together each at the corner 39*d*. The reference symbol 30*u* denotes the substantially rectangular, especially square outer contour of the reflector 30.

FIG. 5 moreover shows a centre axis A of the reflector 30. The light-reflecting partial surfaces 31-38 enclose a reflector interior region 40, which tapers in funnel manner, but with a polygonal cross section with the four corners 39*a-d*, towards the LED array 50. The other light-reflecting partial surfaces 35-38 arranged towards the visible side S are inclined more strongly towards the centre axis A, and thus run more shallow from the visible side S, and form with each other a substantially larger aperture angle than the light-reflecting partial surfaces 31-34.

Figure 6:
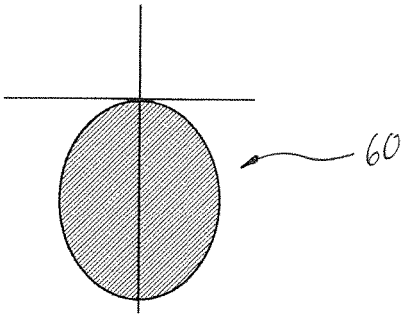
FIG. 6 an exemplary cone of light, in a side view.
Figure 7:
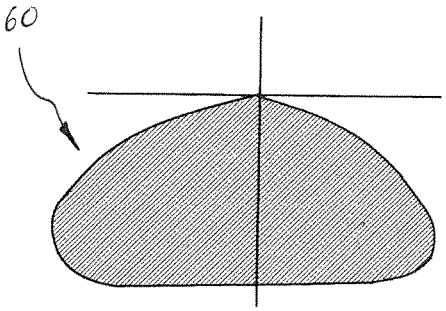
FIG. 7 the exemplary cone of light of FIG. 6 in a front view.

The partial surfaces 32 and 34 configured as free-form surfaces have a bulging convexity towards the reflector interior region 40. The bulging convexity is denoted in FIGS. 5 and 5A by the reference number 45. Such a configuration of the free-form surfaces 32, 34 is particularly useful for adapting the light distribution and emission characteristic of a lighting segment containing the reflector 30, for example to an elongated region which is to be illuminated. FIGS. 6 and 7 illustrate schematically a cone of light 60, such as can be created by means of a reflector 30 with light-reflecting partial surfaces 31-38 according to FIG. 5, 5A, in two directions normal to each other. Specifically, FIG. 6 shows a schematic side view of the cone of light 60, while FIG. 7 shows this from the front. It becomes evident that the cone of light 60 is formed differently in the two viewing directions and, as is made especially clear by FIG. 7, has an elongated shape. This enables an easier and more efficient illumination of elongated premises, such as corridors, see FIG. 1-4.

Figure 8:
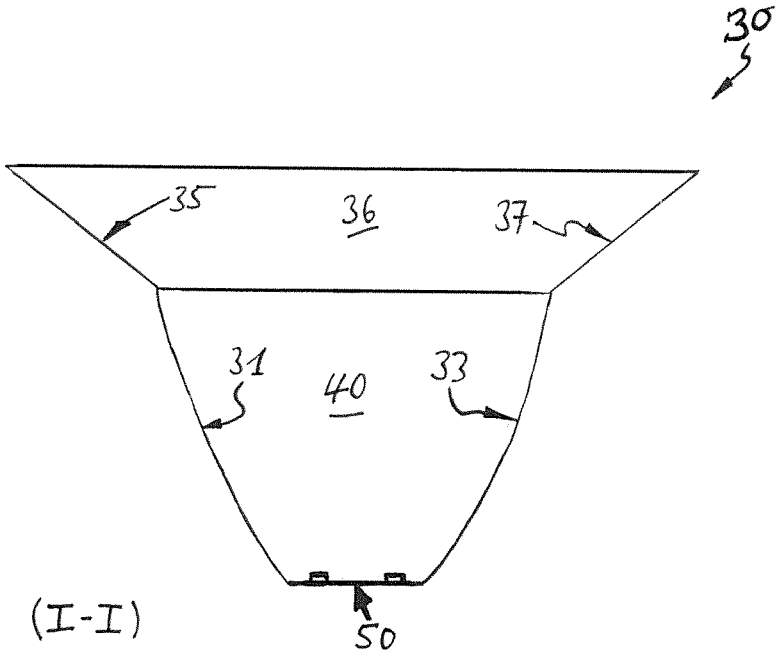
FIG. 8 a schematically simplified representation of the reflector of FIG. 5 in a first cross sectioning plane I-I.
Figure 9:
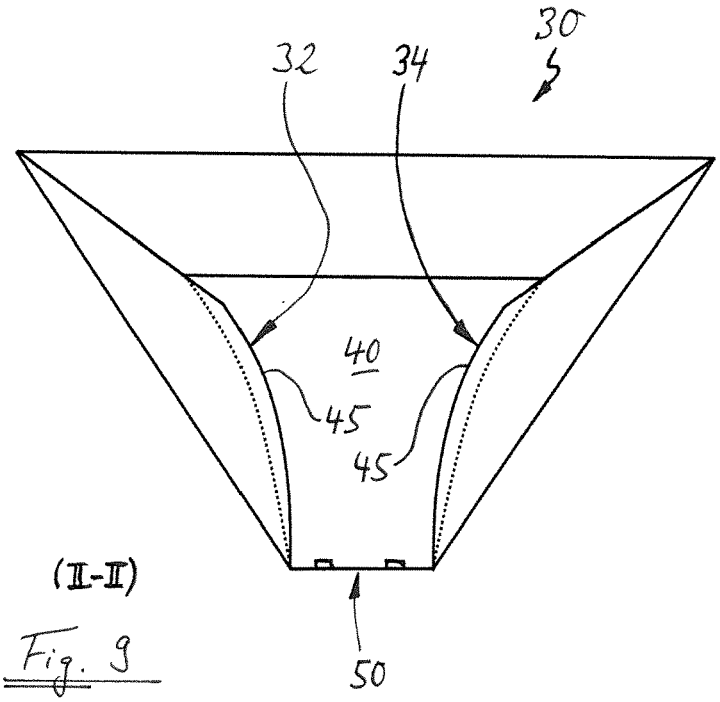
FIG. 9 a schematically simplified representation of the reflector of FIG. 5 in a second cross sectioning plane II-II.

The configuration of the light-reflecting partial surfaces 31-38 is illustrated schematically and in simplified manner in addition by FIGS. 8 and 9. FIG. 8 shows the partial surfaces 31 and 33, designed as standard reflector surfaces, configured with a parabolic shape and provided in particular with a faceted structure, in a middle cross section I-I through the reflector 30, see FIG. 5A. In the middle cross section II-II of FIG. 9, which is normal to the cross section of FIG. 8, cf. FIG. 5A, the partial surfaces 32 and 34 formed with bulging convexities towards the reflector interior region 40 are visible, in schematically simplified manner, as are the schematically indicated (by broken line) lines of intersection of the partial surfaces 32 and 34 with the other two partial surfaces 31 and 33 in the region of the corners 39*a-d* of the reflector 30.

While the form of the reflector 30 cannot be altered by a user, a number of different reflector shapes can be provided, by means of which the emission characteristic of the lighting segment can be modified suitably for different light effects. For some of the lighting segments, such as the lighting segment 7" of FIG. 2, an embodiment of the reflector without free-form surfaces are considered, for example also a reflector with a round interior region 40 in cross section. A user may, for example, for the initial configuration of the light 1, assemble lighting segments 7, 8 from a variety of available lighting segments with different or identical outer contour and different reflector shape in order to satisfy the desired application. For example, different reflectors 30 could be provided for the illumination of corridors of different width.

FIG. 1-4 show several lighting segments 7 with the same square outer contour 9. However, the lighting segments 7 can have different reflector shapes, in other words, the configuration of the reflector of the lighting segment 7' differs from that of the reflector of the lighting segment 7"

and this in turn differs from the configuration of the reflector of the lighting segment 7'''. The same outer contour 9 is not only aesthetically pleasing, but also facilitates the combination of lighting segments 7 with different emission characteristic, especially since the outer contour 9 does not change. If the light 1 is configured by selection of lighting segments from a large number of available lighting segments, the substantially identical outer contour 9 can prove to be practical. For an identical outer contour 9, the outer contours 30*u* of the associated reflectors 30 can likewise be the same, e.g., for all the lighting segments 7 of FIG. 1-4, even if the configuration of the partial surfaces 31-38 varies in order to provide different emission characteristics.

The foregoing remarks on the embodiment of the reflector 30 hold analogously for the lighting segments 8 with the outer contour 10, while in this case the reflector can have, e.g., a round outer contour.

The removably inserted lighting segments 7 and 8 are each interchangeable, so that when needed changes are still possible for the lighting effects after the choice of the initial configuration, and furthermore when necessary a damaged lighting segment can be easily replaced by a new one.

The light 1 as a whole in the mounted state of FIG. 1-4 can still be adjusted or fine tuned, for example, to fine tune the overall orientation of the light 1 and to balance out installation tolerances. This can be done by swiveling the light 1 for example about the two axes A', A", see FIG. 1, especially within a limited angle range. However, alternatively, such an adjustment possibility of the light 1 can be omitted, which further simplifies the construction of the light 1.

Figure 10:
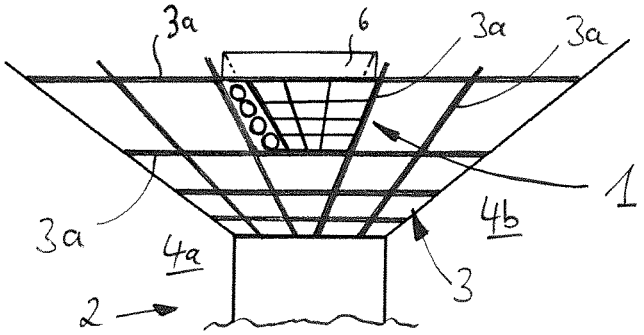
FIG. 10 a schematic representation of an installation situation of the light according to the first exemplary embodiment.

As mentioned, the light 1 according to the first exemplary embodiment is designed as a grid light. The light base body 6 is dimensioned such that it can be suitably received in a grid of the grid ceiling 3. This is shown schematically by FIG. 10, which furthermore shows schematically profile elements 3*a* of the grid ceiling 3. The light base body 6, which in particular can comprise a suitable housing, can furthermore be outfitted with suitable devices in order to hold the light 1 in a grid of the grid ceiling 3 formed by the profile elements 3*a*.

Figure 11:
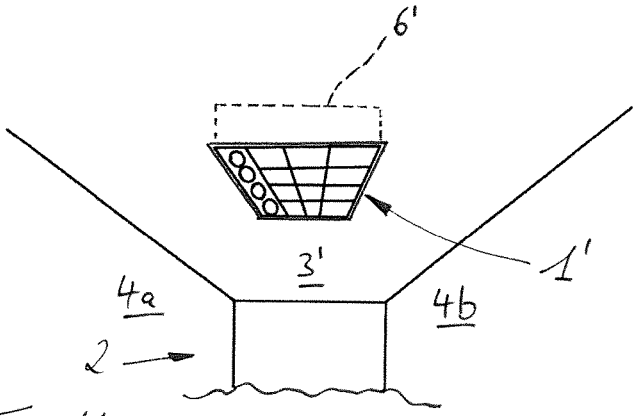
FIG. 11 a schematic representation of an installation situation of a light according to a second exemplary embodiment.

A second exemplary embodiment shown in FIG. 11 differs from the first exemplary embodiment only in that the light 1' is designed as an installed light, rather than a grid light. For this, the light 1' can have a light base body 6' adapted to the installation situation, which in turn can be designed with a suitable housing. A ceiling 3' of the room 2 can for example have a suitable recess to receive the light base body 6'. The ceiling 3' can likewise be in one example a suspended false ceiling, which however does not form a grid ceiling in this example.

Figure 12:
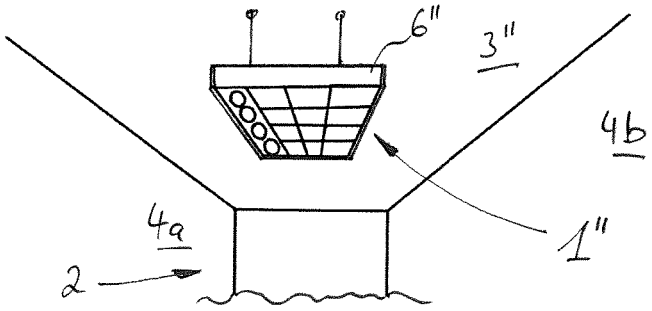
FIG. 12 a schematic representation of an installation situation of a light according to a third exemplary embodiment.

A third exemplary embodiment shown in FIG. 12 differs from the first exemplary embodiment only in that the light 1" is formed in suitable manner and in particular has a suitably configured light base body 6" in order to be used as a suspended light 1". In FIG. 12, the light base body 6" has an independent housing, which remains visible after hanging up the light 1". In FIG. 12, the light 1" is hung for example by cables from a ceiling 3" of the room 2. However, instead of this the light 1" can be suspended by other suitable means from the ceiling 3".

Figure 15:
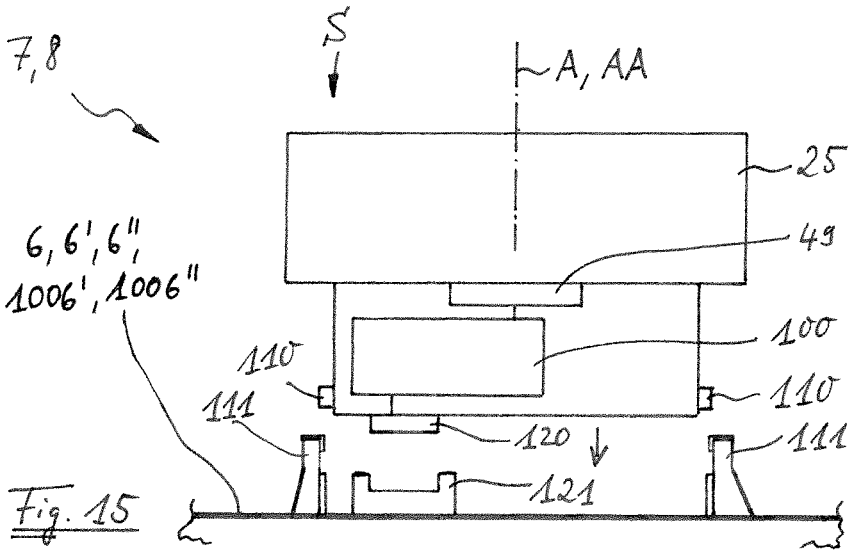
FIG. 15 a schematic greatly simplified representation of a lighting segment for the light of FIG. 1.

A schematic greatly simplified representation of a lighting segment 7 or 8 for the lights according to the above-described exemplary embodiments is shown by FIG. 15, while furthermore a section of the light base body 6, 6' or 6" is shown schematically and simplified. The lighting segment 7, 8 comprises the optical component 25, the light source 49, for example in the form of the LED array 50, an array 100 of electrical and electronic components for energizing and actuation of the light source 49, comprising in particular a converter, locking devices 110 for the mechanical fastening and holding of the lighting segment 7, 8 in the light base body 6, 6', or 6" as well as electrical contacting devices 120 especially for the making of an electrical connection to a power supply, for example at mains voltage, such as 230 V. The light base body 6, 6', or 6" for its part is provided with locking devices 111 at the light base body side and electrical contacting devices 121. The locking devices 111 are designed to engage in locking manner with the locking devices 110 in order to hold the lighting segment 7 or 8 on the light base body 6, 6', or 6", while the electrical contacting devices 121 are designed to make contact with the contacting devices 120 and produce an electrically conductive connection in order to supply electric current to the lighting segment 7, 8. Electrical power supply lines can be provided for this in the light base body 6, 6', or 6", which are not represented in detail in FIG. 15 for sake of clarity.

The components of the array 100, the light source 49 and the contacting means 120 could be arranged for example on a common circuit board or instead be provided separately in a suitable housing.

In other exemplary embodiments of the invention, instead of the reflector 30, as described for the preceding exemplary embodiments, a lens can be used as the optical component 25 in order to influence the emission characteristic of the respective lighting segment 7, 8. A lens 130 and a lens 230, which can be used for example in corresponding modifications of the first to third exemplary embodiments for the influencing of the emission characteristic, are shown schematically in FIGS. 16 and 17, it being understood that the lens 130 or 230 can be adapted in terms of material and geometry to the particular desired light effect and the desired emission characteristic of the lighting segment 7 or 8.

Figure 16:
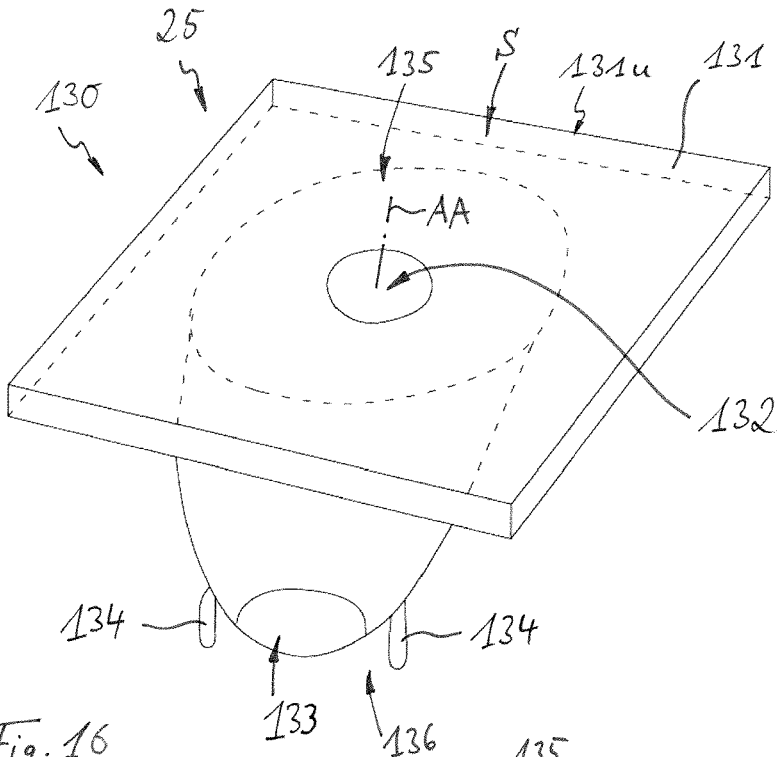
FIG. 16 a lens of a lighting segment for a light according to a fourth exemplary embodiment of the invention, in schematic perspective view.

The lens 130 according to a fourth exemplary embodiment, see FIG. 16, comprises a plate-shaped section 131 on an end-face front side 135, corresponding to a visible side S and on which the lens 130 in the state of use in the light 1 emits light, the outer contour of which in the example of FIG. 16 likewise defines the outer contour 131*u* of the lens 130. In the example of FIG. 16, the outer contour 131*u* of the lens 130 is square, but it is conceivable in modifications of the example of FIG. 16 to provide lenses with round, for example circular round, outer contour 131*u*. The choice of the outer contour 131*u* can also be dependent, in the case of using lenses, on how the positions 7*a*, 8*a* in the light base body 6 are provided and which outer contour 9, 10 the particular lighting segment is supposed to have. FIG. 16 shows the lens 130 together with its indicated centre axis AA.

For the influencing of the emission characteristic which is achieved by using the lens 130, the lens 130 has a recess 132 in the middle on the front side 135, which is provided for the adjusting of the emission characteristic and thus serves as optics for controlling or influencing the emission characteristic. The recess 132 in the lens 130 of FIG. 16 is thus formed in dependence on the desired emission characteristic of the lighting segment which is outfitted with the lens 130.

On a back side 136 of the lens 130 opposite the plate-shaped section 131, there is another recess 133, in which is arranged the light source 49, for example a LED or LED array, in the state of use of the lens 130 in the lighting segment 7 or 8.

Moreover, the lens 130 has on the back side 136 two fixation sections 134, which are formed for example as a bolt or pin and which serve for the fixation of the lens 130, especially to a circuit board. Other kinds of fixation of the lens 130 in the lighting segment 7, 8, especially on a circuit board which also carries the LED or LED array, are also conceivable, however.

Figure 17:
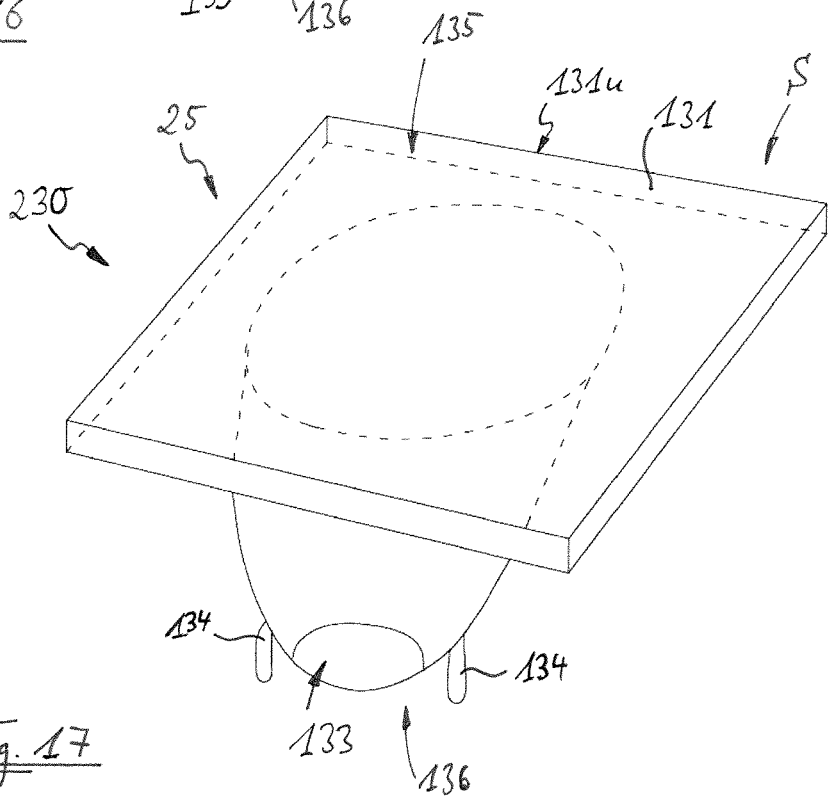
FIG. 17 a lens of a lighting segment for a light according to a variant of the fourth exemplary embodiment, in schematic perspective view.

In one variant of the fourth exemplary embodiment, instead of the lens 130 one can provide a lens 230, see FIG. 17. The lens 230 of FIG. 17 differs from the lens 130 of FIG. 16 merely in that the lens 230 is not provided on the front side 135 with a recess 132 for influencing the emission characteristic. Thus, when the desired emission characteristic of the lighting segment 7 or 8 does not require a recess 132, it can therefore be omitted.

According to the above-described fourth exemplary embodiment and the explained variant thereof, the lighting segments 7 and the lighting segments 8 each comprise a lens 130 or 230 in place of the reflector 30. So far as is necessary, the lighting segment 7, 8 is then suitably designed in each case so as to be able to fasten the lens 130 or 230 in place of the reflector in suitable manner. Furthermore, however, the light according to the fourth exemplary embodiment and its variant is designed as described above for the first exemplary embodiment, and the lights according to the fourth exemplary embodiment and its variant can also be modified as explained above for the second and third exemplary embodiments.

Figure 18:
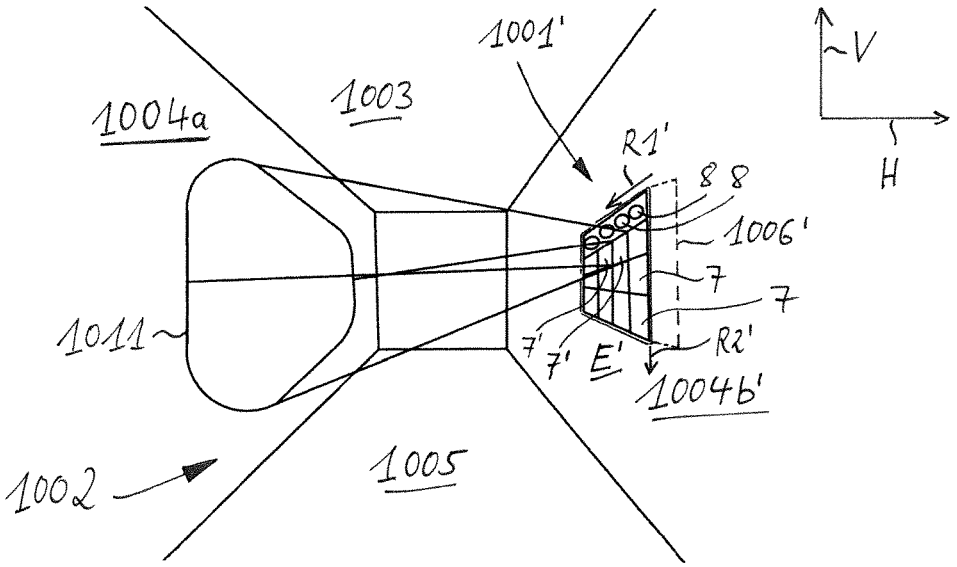
FIG. 18 a light according to a fifth exemplary embodiment of the invention, mounted in the wall region in a room, when creating a schematically represented light effect.
Figure 19:
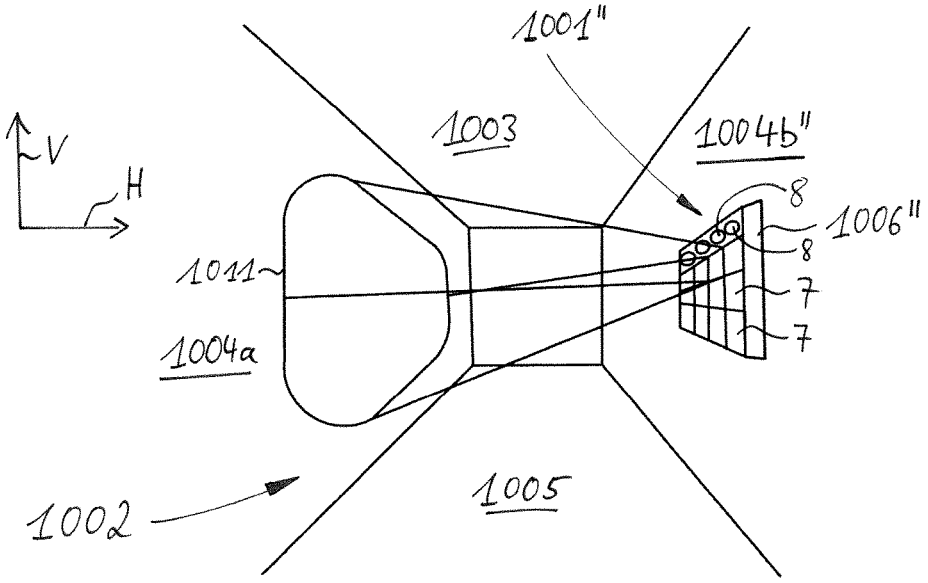
FIG. 19 a light according to a sixth exemplary embodiment of the invention, mounted in the wall region in a room, when creating a schematically represented light effect.

A light 1001' according to a fifth exemplary embodiment and a light 1001" according to a sixth exemplary embodiment are shown by FIGS. 18 and 19. The lights 1001' and 1001" each represent modifications of the above-described exemplary embodiments and their variants, so that except for the following explained differences reference is made to the above remarks.

The light 1001' is installed in the wall region in a room 1002. The room 1002 has a ceiling 1003, a floor 1005 as well as at least a first wall 1004*a* and a second wall 1004*b*' situated opposite to it. The light 1001' is installed in the second wall 1004*b*', wherein the light 1001' for this has a light base body 1006' adapted to the installation situation in the wall 1004*b*'. The light base body 1006' in the exemplary embodiment of FIG. 18 is configured with a housing which is designed for installation in the wall 1004*b*'. The light base body 1006' in FIG. 18 is received in a suitable recess in the wall 1004*b*' and held with the aid of holding means, which are not shown.

In the sixth exemplary embodiment of FIG. 19 the light 1001" is likewise installed in the wall region. Once again, the room 1002 has two walls 1004*a* and 1004*b*". The light 1001" is mounted on the surface of the wall 1004*b*". The light 1001" is designed for this and comprises in particular a light base body 1006" so that it can be used as a surface-mounted light 1001". The light base body 1006" of FIG. 19 comprises an independent housing, which remains visible after the mounting of the light 1001" on the wall 1004*b*".

Both FIG. 18 and FIG. 19 show schematically the producing of a light effect 1011 on the first wall 1004*a*. However it is understood that the light 1001' and the light 1001" can each be used to produce different light effects, similar to the producing of light effects by the lights 1, 1', 1". In addition in this case, in the exemplary embodiments of FIG. 18, 19, suitable lighting segments 7, 8 can be used to produce light effects not only on the wall 1004*a*, but also on the floor 1005 and/or on the ceiling 1003. Refer to the above remarks for this.

In the light 1001', the lighting segments 7 and 8 in their inserted state thus form an arrangement, see FIG. 18, which extends in a plane E', while the plane E' in FIG. 18 extends, in the mounted state of the light 1001', vertically and parallel to a plane in which the wall 1004*b*' extends. In the case of an installed light 1001', the plane E' and the plane of the wall 1004*b*' can coincide. The plane E' is subtended by two directions R1', R2', which run in FIG. 18 perpendicular to each other and parallel to the wall 1004*b*', or run in the plane of the wall 1004*b*'. Also in the light 1001" of FIG. 19 the lighting segments 7 and 8 form an arrangement which extends in a vertical plane parallel to the wall 1004*b*", which is not drawn in FIG. 19.

In particular, it should be mentioned that the above remarks on FIG. 15 also apply to the lights 1001', 1001".

The above-described switching and/or controlling of the output of light of the lighting segments 7, 8, individually, combined in disjunctive and/or overlapping subgroups, or all together can occur, in a variant not represented for all of the above-described exemplary embodiments, by means of current-carrying cables leading to the individual lighting segments, and switches or dimmers. For this, for example, switching subgroups can already be established during the installation of the light 1, 1', 1", 1001', 1001" and a suitable number of switches or dimmers can be provided for these subgroups. The electrical interconnection of the lighting segments 7, 8 with the switches or dimmers then establishes whether and how the lighting segments 7, 8 can be switched or controlled all together or individually or in subgroups with regard to their output of light.

Figure 13:
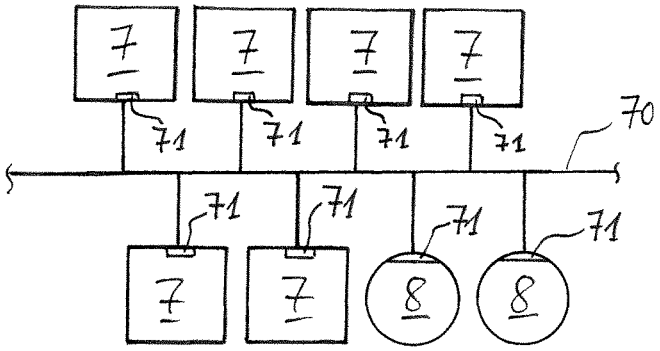
FIG. 13 a schematic representation of the actuation of lighting segments by a bus.

In another variant of the above-described exemplary embodiments, however, the switching and/or controlling of the output of light of the lighting segments 7, 8 is mediated by a bus 70 in the manner shown schematically in FIG. 13. Each of the lighting segments 7, 8, for example, is connected to a power supply, which is not shown in detail in FIG. 13. The activating, deactivating or dimming of the lighting segments 7, 8 in the variant of FIG. 13 is done for example with the aid of addresses assigned to the lighting segments 7, 8 and/or a suitable protocol, as well as control and/or switching instructions transported in suitable form by the bus 70. Thus, the lighting segments 7, 8 can be addressed in an especially flexible and variable manner. Alternatively, in place of the bus 70 a control network can be used. Each of the lighting segments 7, 8, see FIG. 13, comprises a device 71, which makes it possible to receive control signals for the switching and/or controlling of the output of light of the lighting segment 7 or 8 in wired manner via the bus 70. In this case, the device 71 comprises an interface for connection to the bus 70. Alternatively, the interface can be designed for connection to a wired network.

Figure 14:
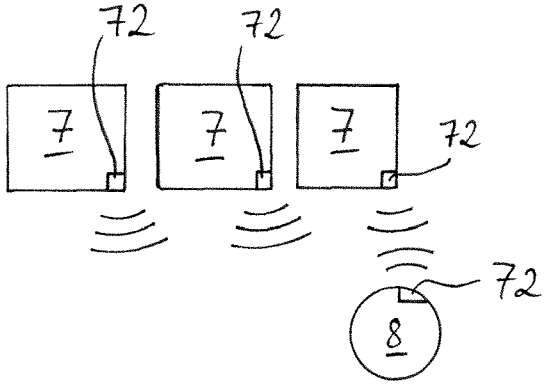
FIG. 14 a schematic representation of the actuation of lighting segments in wireless manner.

In another variant of the above-described exemplary embodiments, the control and/or the switching of the output of light of the individual lighting segments 7, 8 is not wired, but instead wireless, which avoids the laying of lines. This is shown schematically in FIG. 14. Each of the lighting segments 7 and 8 comprises a communication device 72, which enables a reception of control signals for the switching and/or controlling of the output of light in wireless manner. In particular, the communication device 72 comprises an interface for communication by a wireless protocol.

It should be mentioned that, in addition to the devices 71 or 72, each of the lighting segments 7, 8 can furthermore comprise a computing device for the processing of the control signals as well as a driver component enabling the variation of the emitted light power in accordance with the control signals.

The devices 71 or 72 as well as the computing device and the driver component can be part of the array 100 shown schematically in FIG. 15.

Moreover, it should be mentioned that the lighting segments 7, 8 and the light base body 6, 6', 6", 1006' or 1006" in the above-described exemplary embodiments can have contacting means 120, 121, see FIG. 15, which are not only suited to making an electrical contact between the lighting segments 7, 8 and a power supply, but also, to the extent that a wired control system should be possible, they furthermore allow for making a contact with a data line, such as the bus 70, for example. Alternatively, it would be conceivable to provide separate contacting means for the data line.

Although the present invention has been fully described with the aid of exemplary embodiments in the preceding, it is not confined to them, but instead can be modified in many different ways.

The invention is in particular not confined to a light with the number and combination of lighting segments as indicated in the exemplary embodiments. There could be provided more or fewer lighting segments, wherein these for example can all have a rectangular or square outer contour. Many different numbers and combinations of lighting segments are conceivable.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 102016217332.4, filed Sep. 12, 2016 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A light, with a light base body; and lighting segments which are inserted into the light base body;

wherein each of the lighting segments emits light in a directional manner and has a predefined emission characteristic;

wherein the emission characteristics of the lighting segments comprise at least two different emission characteristics;

wherein the inserted lighting segments form an array extending in a plane, the lighting segments being arranged in a fixed orientation; and wherein, by the light, light effects are achievable in horizontal and vertical partial areas of a room in a building.

2. The light of claim 1, wherein the lighting segments can be inserted into the light base body at predefined positions in removable manner.

3. The light of claim 1, wherein the lighting segments can be inserted into the light base body at predefined, regularly arranged positions.

4. The light of claim 1, wherein the lighting segments can be inserted into the light base body such that the plane in which the array extends is a horizontal or vertical plane in a mounted state of the light.

5. The light of claim 1, wherein the lighting segments each have an optical component which is used in each case to accomplish the emission characteristic of the lighting segment.

6. The light of claim 5, wherein at least one of the lighting segments comprises a reflector as the optical component.

7. The light of claim 6, wherein at least one of a plurality of light-reflecting partial surfaces of the reflector is designed as at least part of a standard reflector surface and at least one is designed as a free-form surface.

8. The light of claim 7, wherein at least two of the light-reflecting partial surfaces are designed in each case as at least part of a standard reflector surface and at least two of the light-reflecting partial surfaces are designed in each case as a free-form surface.

9. The light of claim 7, wherein in each case adjacent light-reflecting partial surfaces are joined together at one of a plurality of corners of the reflector.

10. The light of claim 7, wherein at least one of the free-form surfaces is designed as a bulging convexity towards a reflector interior region.

11. The light of claim 6, wherein the reflector comprises two light-reflecting partial surfaces, each one configured as at least part of a standard reflector surface, which are arranged opposite each other, and wherein moreover the reflector comprises two light-reflecting partial surfaces configured as free-form surfaces, which are arranged opposite each other.

12. The light of claim 6, wherein the reflector is designed with four light-reflecting sides.

13. The light of claim 6, wherein the reflector has at least one light-reflecting partial surface configured as a free-form surface.

14. The light of claim 5, wherein the light is outfitted with lighting segments so that the light has such optical components of at least two differently designed types.

15. The light of claim 1, wherein at least one of the lighting segments comprises a lens as the optical component.

16. The light of claim 1, wherein the lighting segments include interchangeable lighting segments.

17. The light of claim 1, wherein the output of light of the lighting segments can be controlled specifically for at least one of individual lighting segments and subgroups of lighting segments so that different light effects can be achieved by means of the light.

18. The light of claim 17, wherein the output of light of the lighting segments can be controlled such that several lighting segments of a first subgroup of the lighting segments can be activated at the same time to put out light, in order to create a first light effect by the interaction of the lighting segments of the first subgroup, and wherein moreover several lighting segments of another subgroup of the lighting segments can be activated at the same time to put out light, in order to create another light effect by the interaction of the lighting segments of the other subgroup, which is different from the first light effect.

19. The light of claim 17, wherein the light effects comprise at least one of a specific illumination of a wall or a predefined area of a wall, a specific illumination of a floor or a predefined area of a floor, and a specific illumination of an object placed in a room or a person located in a room.

20. The light of claim 17, wherein the light effects comprise at least one of a specific illumination of a wall or a predefined area of a wall, a specific illumination of a floor or a predefined area of a floor, a specific illumination of a ceiling or a predefined area of a ceiling, and a specific illumination of an object placed in a room or a person located in a room.

21. The light of claim 1, wherein the lighting segments each comprise a device which makes it possible to receive control signals for the controlling of the output of light of the lighting segment in at least one of a wireless and wired manner, and wherein the lighting segments are designed to control the output of light in accordance with the control signals.

22. The light of claim 21, wherein the lighting segments each comprise at least one of a communication device, which enables a reception of the control signals in wireless manner, and an interface for connection to a wired network which enables the reception of the control signals.

23. The light of claim 1, wherein an outer contour of at least one of the lighting segments is polygonal.

24. The light of claim 1, wherein an outer contour of at least one of the lighting segments is round.

25. The light of claim 1, wherein an outer contour of at least one of the lighting segments is round and an outer contour of at least one other of the lighting segments is polygonal.

26. The light of claim 1, wherein the light is designed for at least one of an arrangement of the light in the ceiling region and an arrangement of the light in the wall region.

27. The light of claim 1, wherein the light is designed as a grid light for arrangement in a grid ceiling or as an installed light or for use as a suspended light or for mounting on a wall.

28. The light of claim 1, wherein the lighting segments are each outfitted with an LED to produce light.

* * * * *